US006948195B2

(12) United States Patent
Culmer

(10) Patent No.: US 6,948,195 B2
(45) Date of Patent: Sep. 27, 2005

(54) TOILET AND TOILET INSERT

(76) Inventor: Neugyen Culmer, Richards Addition 01, P.O. Box CB 11034, Nassau (BS)

( * ) Notice: Subject to any disclaimer, the term of this patent is extended or adjusted under 35 U.S.C. 154(b) by 0 days.

(21) Appl. No.: 10/983,657

(22) Filed: Nov. 9, 2004

(65) Prior Publication Data

US 2005/0160524 A1 Jul. 28, 2005

(51) Int. Cl.[7] ..... E03D 11/00; E03D 9/00
(52) U.S. Cl. ..... 4/420; 4/300.3; 4/DIG. 5
(58) Field of Search ..... 4/234, 237, 300.3, 4/311, 420, 420.3, DIG. 5

(56) References Cited

U.S. PATENT DOCUMENTS 2,185,887 A * 1/1940 Dennis ..... 4/311
5,960,481 A * 10/1999 Deveer ..... 4/237
6,085,365 A * 7/2000 Chiang ..... 4/420
6,314,591 B1 * 11/2001 Schildt ..... 4/420

* cited by examiner

*Primary Examiner*—Tuan Nguyen
(74) *Attorney, Agent, or Firm*—Wenderoth, Lind & Ponack, L.L.P.

(57) ABSTRACT

A toilet for use by a male to sit while urinating. The toilet comprises a tank, a bowl and a base. The bowl has a back portion, a front portion and a top. The back portion is disposed between the front portion and the tank. The base is disposed so as to support the bowl. The bowl comprises an extended portion, a penis shelf and a disposal path. The extended portion is located at the front portion of the bowl and is shaped to have a height, width and curvature that prevent urine from escaping over the top of the bowl. The penis shelf is arranged and designed to permit a penis to rest thereon such that during urination, urine is discharged toward the disposal path.

5 Claims, 12 Drawing Sheets

TOILET AND TOILET INSERT

BACKGROUND OF THE INVENTION

The present invention relates to toilets, and in particular, toilets for use by males.

FIG. 1 illustrates a conventional toilet 100 that includes a tank 102, a base 104, a bowl 106, a seat 108, and spacers 110. Bowl 106 is capable of holding an amount of water and includes an outlet to discharge the water out from the bowl into pipes connected thereto when toilet 100 flushes. Tank 102 additionally contains an amount of water. When toilet 100 flushes, a portion of the water from tank 102 is discharged from tank 102 to draw the water from bowl 106. After water from bowl 106 is emptied into the pipes connected to bowl 106, another portion of the water from tank 102 is used to refill bowl 106. Tank 102 is then refilled by an external supply of water via piping (not shown).

As illustrated in FIG. 1, when seat 108 is located in the seating use position, spacers 110 rest on bowl 106. In the seating use position, a space 112 is provided where spacers 110 separate seat 108 from bowl 106.

As bowl 106 is designed to receive solid and liquid waste, bowl 106 is conducive to bacterial, viral and fungal growth. Accordingly, water in bowl 106 is typically contaminated.

There are two problems associated with the use of toilet 100 by males.

With respect to the first problem, when an adult male is sitting on toilet 100, there is a chance that the flaccid penis of the adult male will contact the contaminated water in bowl 106 thereby increasing chances of infection. Obviously, this can become a health problem for the adult male using toilet 100. However, there is a chance that a penis that has been infected by contacting contaminated toilet water can pass the infection to others during sexual intercourse and lead to other infections. For example, the contamination, if transferred to a female, could result in a yeast infection.

The second problem deals with urine escaping the toilet when a male is urinating while sitting on the toilet. For example, there are times when the location of the head of the penis is positioned such that during urination, urine flows through space 112 thereby soiling the outside of the toilet and the floor. Typically, in such situations, the male is unaware of the unfortunate positioning of the head of the penis until the urine is seen (or in even less fortunate cases, felt) by the male. There are other times when an erection causes urine to flow over seat 108, which soiling the outside of the toilet and the floor. The conventional method to prevent these situations usually involves waiting for the erection to pass or manually pushing the erect penis so as to point into bowl 106 while urinating.

SUMMARY OF THE INVENTION

The present invention improves the problems associated with prior art toilet discussed above.

The purpose of the present invention is to provide a clean healthy waste disposal environment for males that can reduce occurrences of urine escaping the toilet.

The present invention is directed to a toilet and toilet insert that protects the penis from contamination in the bowl and prevent urine from escaping the bowl.

In accordance with an aspect of the present invention, a penis rest is disposed in the bowl to allow the penis to be positioned in a horizontal manner. This penis rest prevents the penis from dropping into the contaminated water of the bowl to thereby avoid contracting infections.

In accordance with another aspect of the present invention, an extended front portion of the bowl prevents urine from escaping the bowl and soiling the outside of the toilet and the floor.

In accordance with one embodiment of the present invention, a toilet includes a penis rest, a plurality of holes operable to permit a discharge of cleaning fluid into the bowl of the toilet and a urine disposal portion. The urine disposal portion may include a projected lip disposed so as to prevent urine from escaping from outside of the toilet, a urine disposal path and an outlet for disposing urine into the toilet bowl.

In accordance with another embodiment of the present invention, a toilet insert comprises a penis shelf, a projected lip, a disposal path and outlet.

In accordance with another embodiment of the present invention, a penis rest insert may be used with a toilet having a projected lip disposed so as to prevent urine from escaping from outside of the toilet, a urine disposal path and an outlet for disposing urine into the toilet bowl.

In accordance with another embodiment of the present invention, a penis rest insert may be used with a conventional toilet.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate exemplary embodiments of the present invention and, together with the description, serve to explain the principles of the invention. In the drawings.

DETAILED DESCRIPTION OF THE INVENTION

An exemplary embodiment of a toilet in accordance with the present invention comprises any material used for conventional toilets, for example porcelain.

The present invention allows a man to sit and both urinate and defecate.

Figure 1:
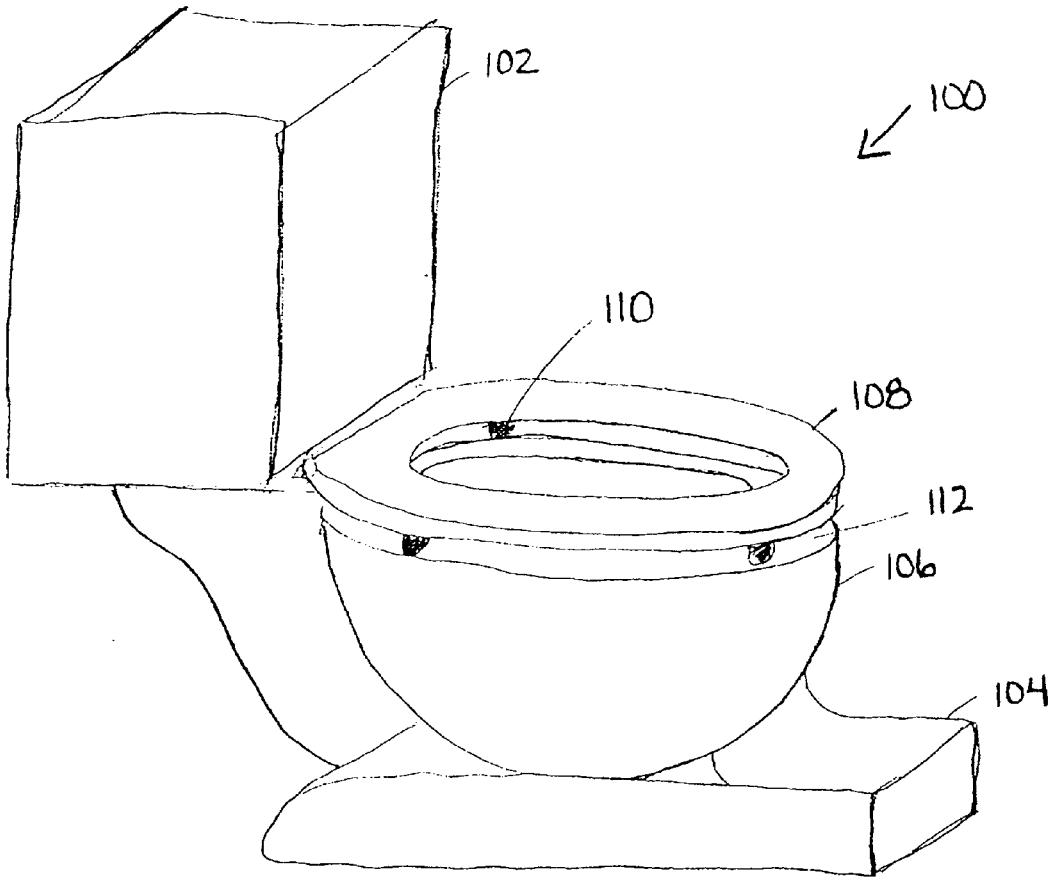
FIG. 1 PRIOR ART
FIG. 1 is an oblique view of a prior art conventional toilet.
Figure 2:
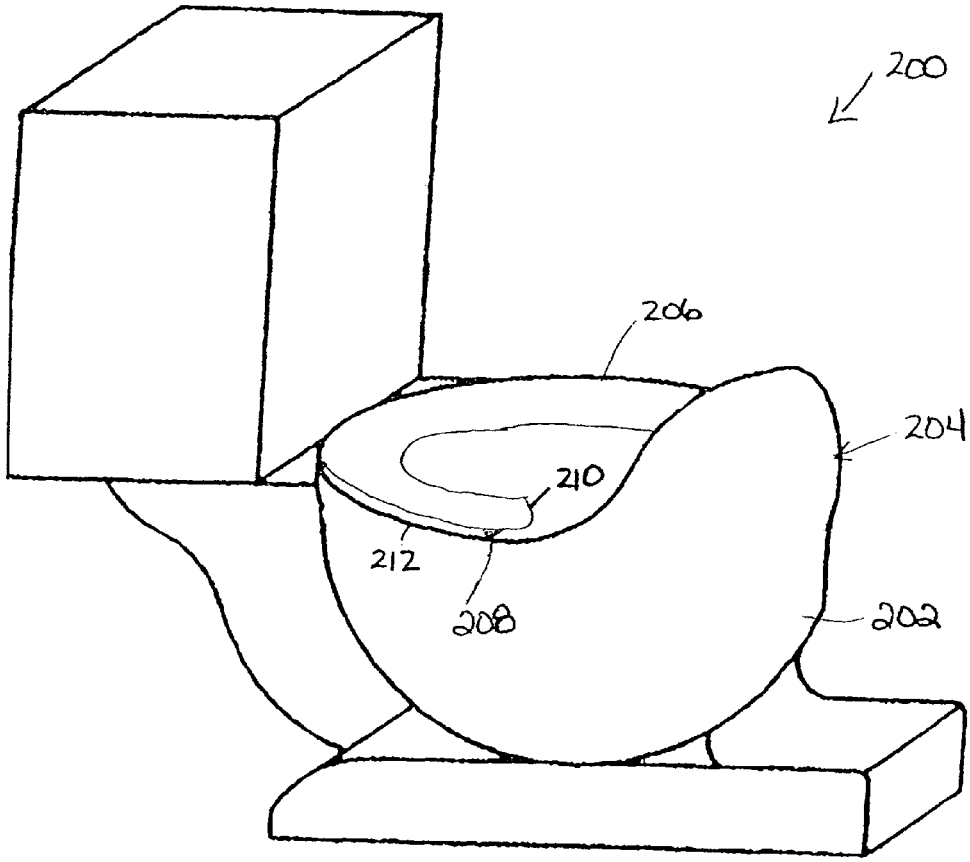
FIG. 2 is an oblique view of a toilet with an extended portion at the top of the bowl in accordance with an exemplary embodiment of the present invention.

FIG. 2 is an oblique view of a toilet 200 with an extended portion 204 at the top of the bowl 202 in accordance with an exemplary embodiment of the present invention.

Bowl 202 holds an amount of water and includes an outlet to discharge the water out from the bowl into pipes connected thereto when toilet 200 flushes. When toilet 200 flushes, a portion of the water from the tank is discharged from the tank to draw the water from bowl 202. After water from bowl 202 is emptied into the pipes connected to bowl 202, another portion of the water from the tank is used to refill bowl 202. The tank is then refilled by an external supply of water via piping (not shown).

Toilet 200 additionally includes a raisable seat portion 206 having optional spacers 208 to space the seat portion 206 from the top portion of bowl 202 and two end portions 210. End portions 210 are arranged to prevent obstruction, by extended portion 204, of placement of seat portion 206 onto the top portion of bowl 202.

Extended portion 204 is shaped to have a height, width and curvature that prevent urine from escaping over the top portion of bowl 202. Even in situations wherein the male that is sitting on the toilet is urinating with an erection, the discharged urine will contact the inside surface of extended portion 204 and drain into bowl 202.

Figure 3:
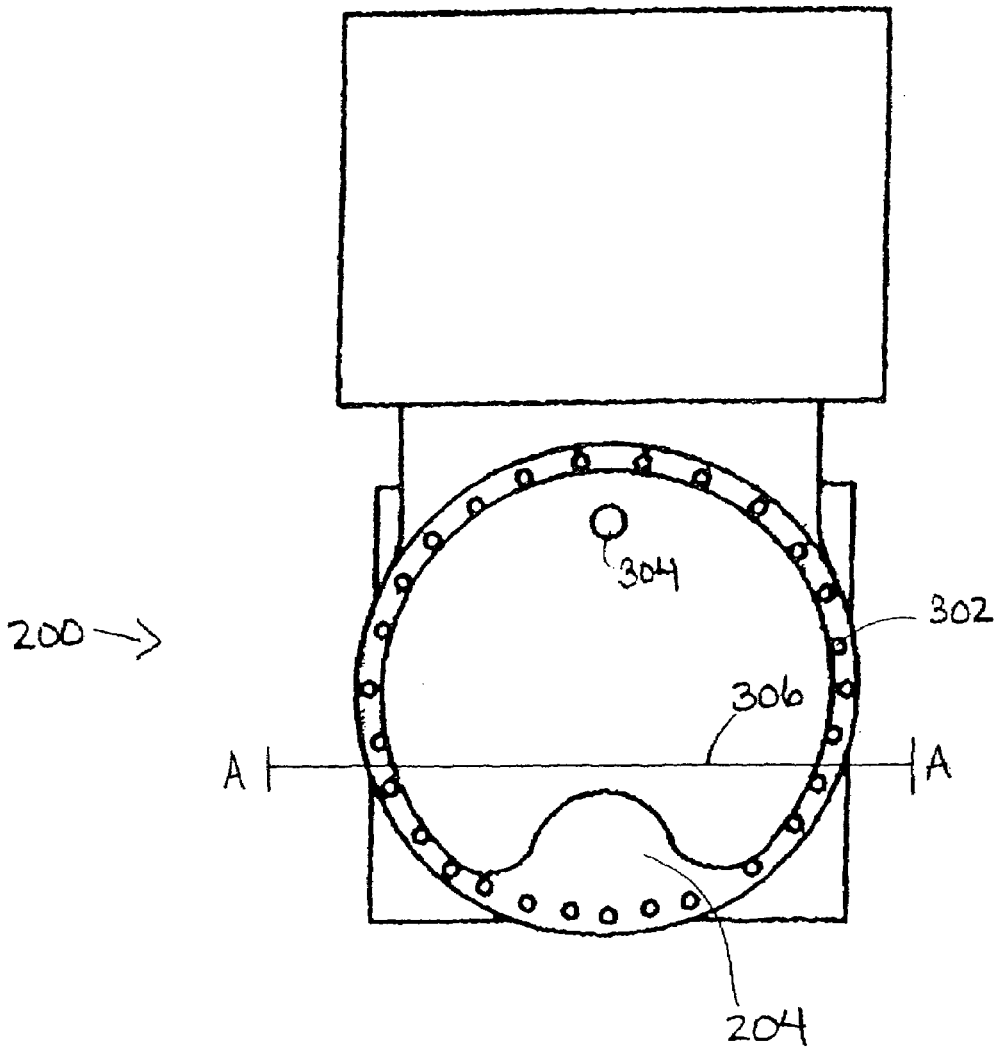
FIG. 3 is a plan view of the toilet of FIG. 2.

FIG. 3 is a plan view of toilet 200. As illustrated in FIG. 3, toilet 200 includes a hole 304 arranged and constructed to permit flushing of contents of the bowl 202 and a plurality of discharge holes 302 arranged about the parameter of the top portion of bowl 202. Discharge holes 302 discharge water into bowl 202 during flushing and refilling. Further, toilet 200 may include a disinfecting fluid source that mixes a disinfecting fluid with the water to be discharged out of holes 302. The disinfecting fluid may help to decrease bacterial, viral and fungal growth within bowl 202.

Further, toilet 200 includes a shelf 306 arranged and designed to permit a penis to rest thereon. Shelf 306 prevents a flaccid penis of an adult male from contacting the contaminated water in bowl 202 thereby decreasing chances of infection.

Figure 4:
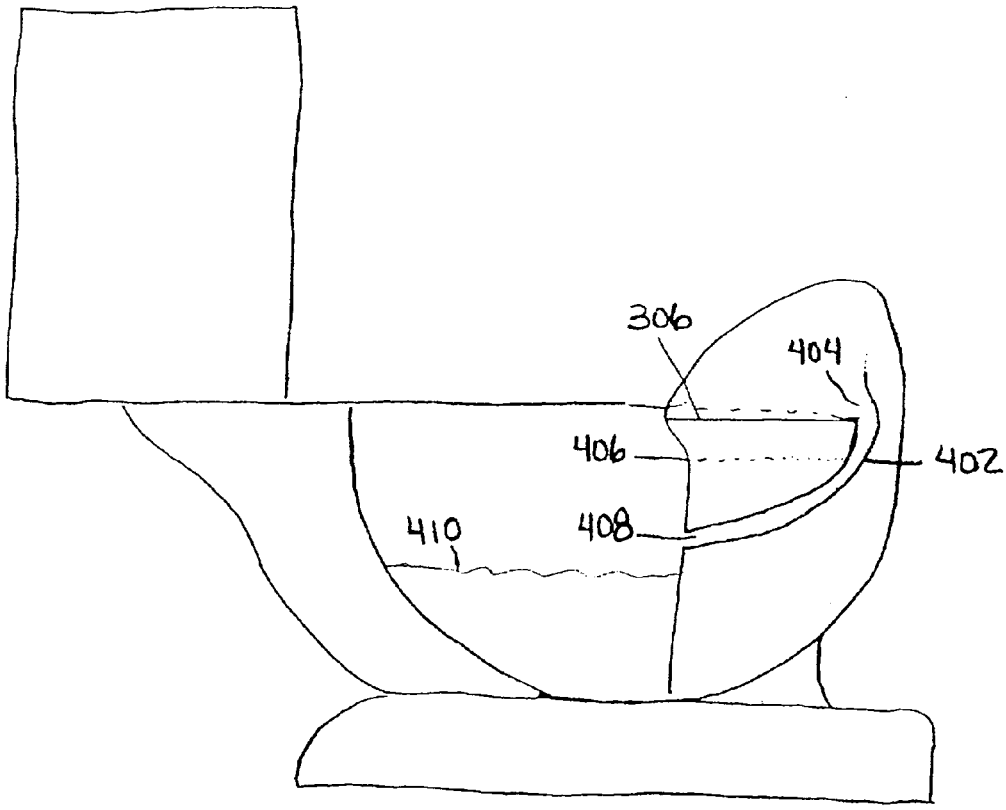
FIG. 4 is a cross-sectional side view of the toilet of FIG. 2.

FIG. 4 is a side view of toilet 200 of FIG. 2. As illustrated in FIG. 4, toilet 200 includes a urine removal portion having opening 404, disposal path 402 and outlet 408. Opening 404 is shaped and arranged to direct the flow of urine from shelf 306 and into disposal path 402. Disposal path 402 may comprise piping, such as metal or plastic. Further disposal path 402 may be exposed within bowl 202 or may be encased within the wall of toilet 200. As illustrated in FIG. 4, outlet 408 is disposed so as to be above waterline 410 in order to discharge urine into the bowl and to prevent contents within the bowl from entering disposal path 402. This positioning of outlet 408 decreases the time of contact between the outlet 408 (and even an inside portion of disposal path 402) and the liquid waste thereby decreasing bacterial, viral and fungal growth on outlet 408 (and the inside portion of disposal path 402).

As further illustrated in FIG. 4, shelf 306 is positioned at a height equal to the top of bowl 202. In another exemplary embodiment, shelf 306 is positioned at a height designated at 406, wherein the height is between the top of bowl 202 and waterline 410 and provides a more comfortable position to rest the penis.

Figure 5:
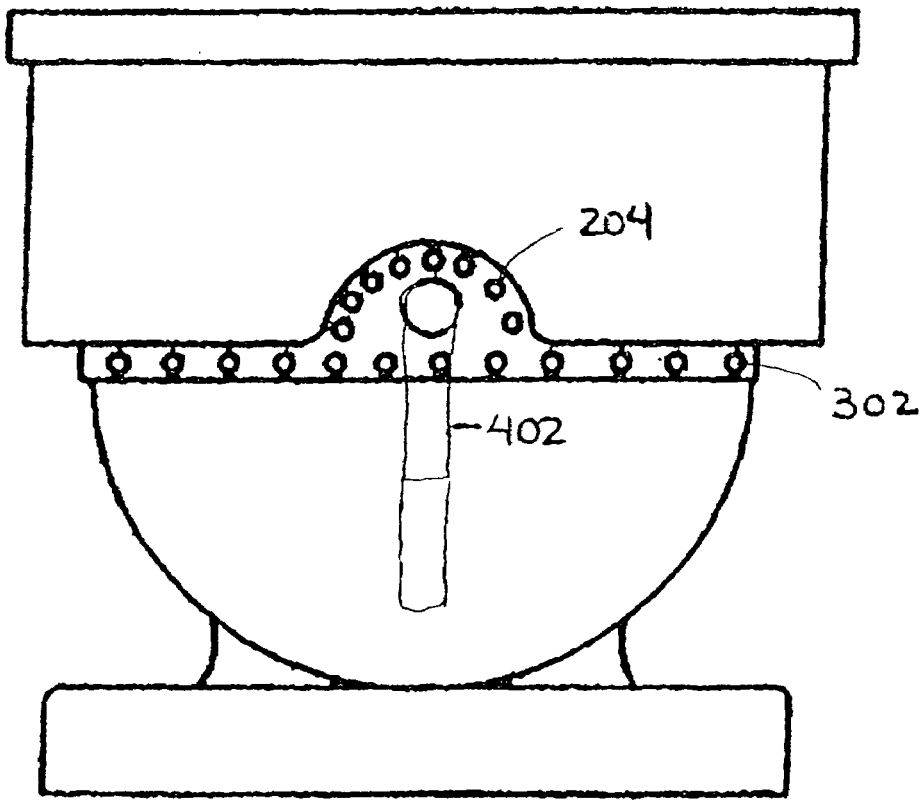
FIG. 5 is a front view of the toilet of FIG. 2.

FIG. 5 is a front view of toilet 200 of FIG. 2.

Figure 6A:
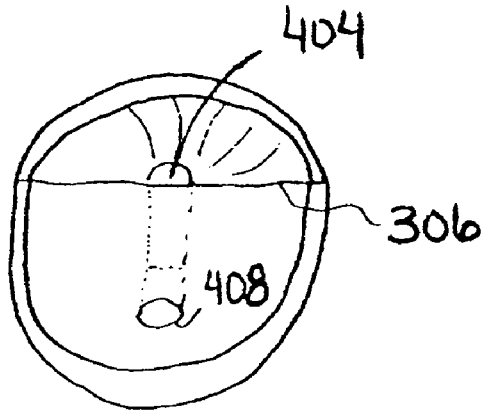
FIGS. 6A and 6B are cross-sectional views taken along line AA of FIG. 3.
Figure 6B:
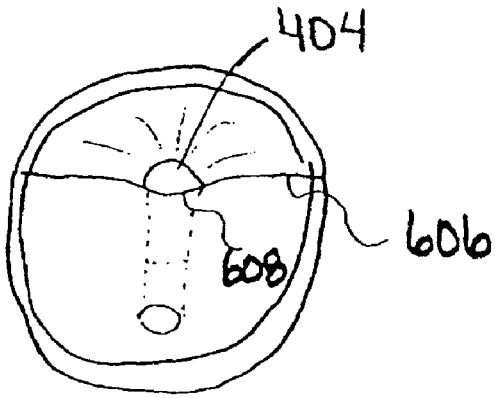

FIG. 6A is a cross-sectional view of a line AA as illustrated in FIG. 3 in accordance with one embodiment of the present invention. As illustrated in the figure, penis shelf 306 is generally planar. On the contrary, as illustrated in FIG. 6B, which depicts a second embodiment of the present invention, penis shelf 606 includes a depressed portion 608 for centering the penis with hole 404. Furthermore, in accordance with yet another embodiment of the present invention, the penis shelf can be curved and/or sloped in order to permit gravity to urge urine away from the penis towards hole 404. In further embodiments, as discuss above, either one of shelf 306 or 606 may be disposed at a height that is between the top of bowl and the waterline in order to provide a more comfortable position to rest the penis.

Figure 7:
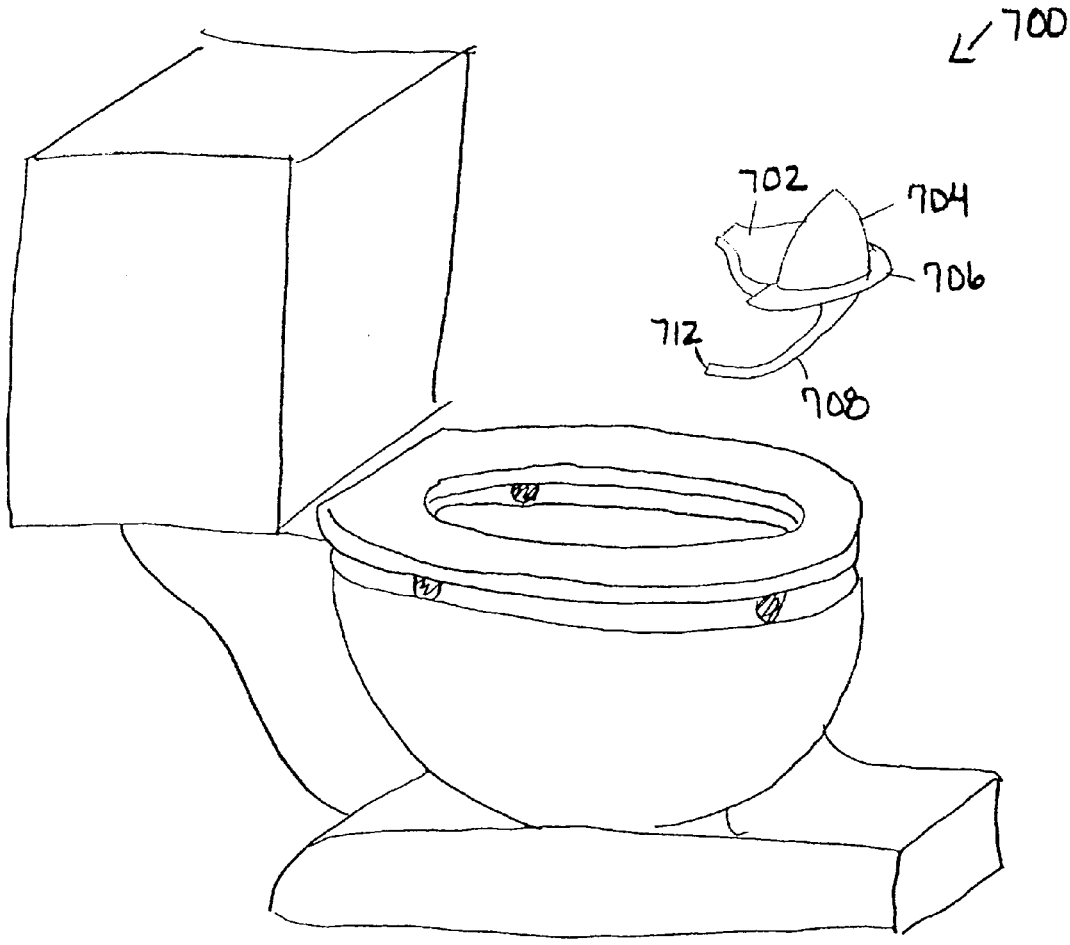
FIG. 7 is an oblique view of a toilet insert in accordance with an embodiment of the present invention for use with a conventional toilet.

A further exemplary embodiment of the present invention, for example as illustrated in FIG. 7, includes an insert 700 comprising an extended portion 704, a penis shelf 702, a disposal path 708 and an outlet 712. Furthermore, as illustrated in FIG. 7, the insert includes a lip 706, for resting the insert onto a seat of an existing toilet.

Figure 8A:
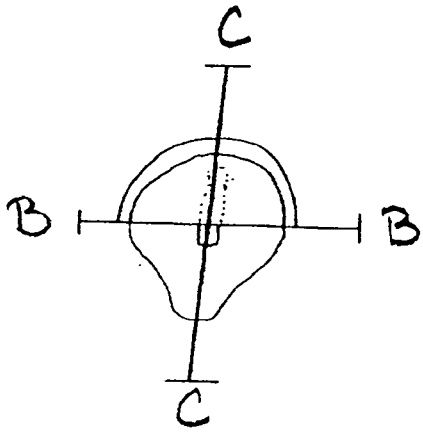
FIG. 8A is a top view of the toilet insert depicted in FIG. 7.
Figure 8B:
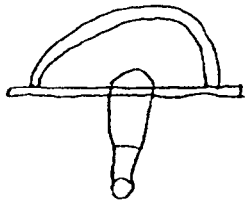
FIG. 8B is a cross-sectional view of the toilet insert taken along line BB of the FIG. 8A.
Figure 8C:
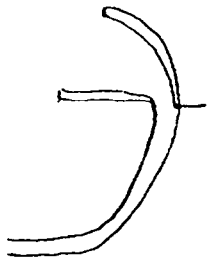
FIG. 8C is a cross-sectional view of the toilet insert taken along line CC of the FIG. 8A.

FIG. 8A illustrates a plan view of the toilet insert 700 of FIG. 7. FIG. 8B is a cross-sectional view along lines BB of FIG. 8A. FIG. 8C is a cross-sectional view along the lines of CC of FIG. 8A.

Figure 9A:
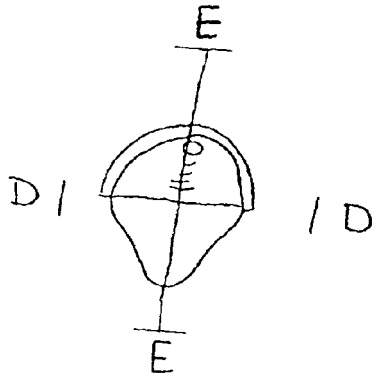
FIG. 9A is a top view of the toilet insert depicted in FIG. 8A.
Figure 9B:
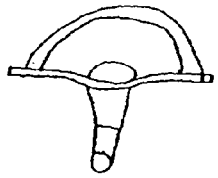
FIG. 9B is a cross-sectional view of the toilet insert taken along line BB of the FIG. 9A.
Figure 9C:
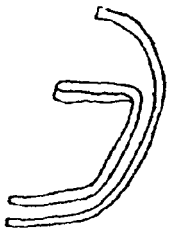
FIG. 9C is a cross-sectional view of the toilet insert taken along line CC of the FIG. 9A.

FIGS. 9A–9C illustrate a further exemplary embodiment of the insert of FIG. 7 wherein the penis shelf includes a centering depression in order to center the penis with the hole for urine disposal.

Figure 10A:
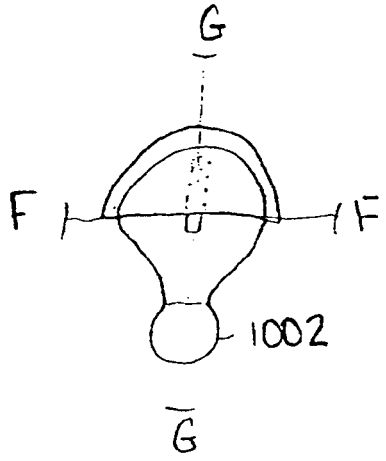
FIG. 10A is a top view of the toilet insert depicted in FIG. 9A.
Figure 10B:
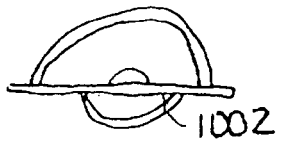
FIG. 10B is a cross-sectional view of the toilet insert taken along line BB of the FIG. 9A.
Figure 10C:
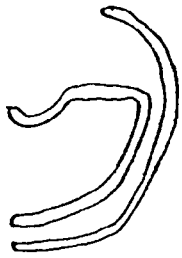
FIG. 10C is a cross-sectional view of the toilet insert taken along line CC of the FIG. 9A.

In a further exemplary embodiment, for example as illustrated in FIGS. 10A–C, the shelf may include a scrotum holding portion 1002, arranged and constructed so as to receive the scrotum of the user.

It should be noted that any of the exemplary inserts illustrated in FIGS. 7–10 may be designed such that when the insert is placed on a toilet, the shelf of the insert is disposed at a height that is between the top of bowl and the waterline in order to provide a more comfortable position to rest the penis.

Figure 11:
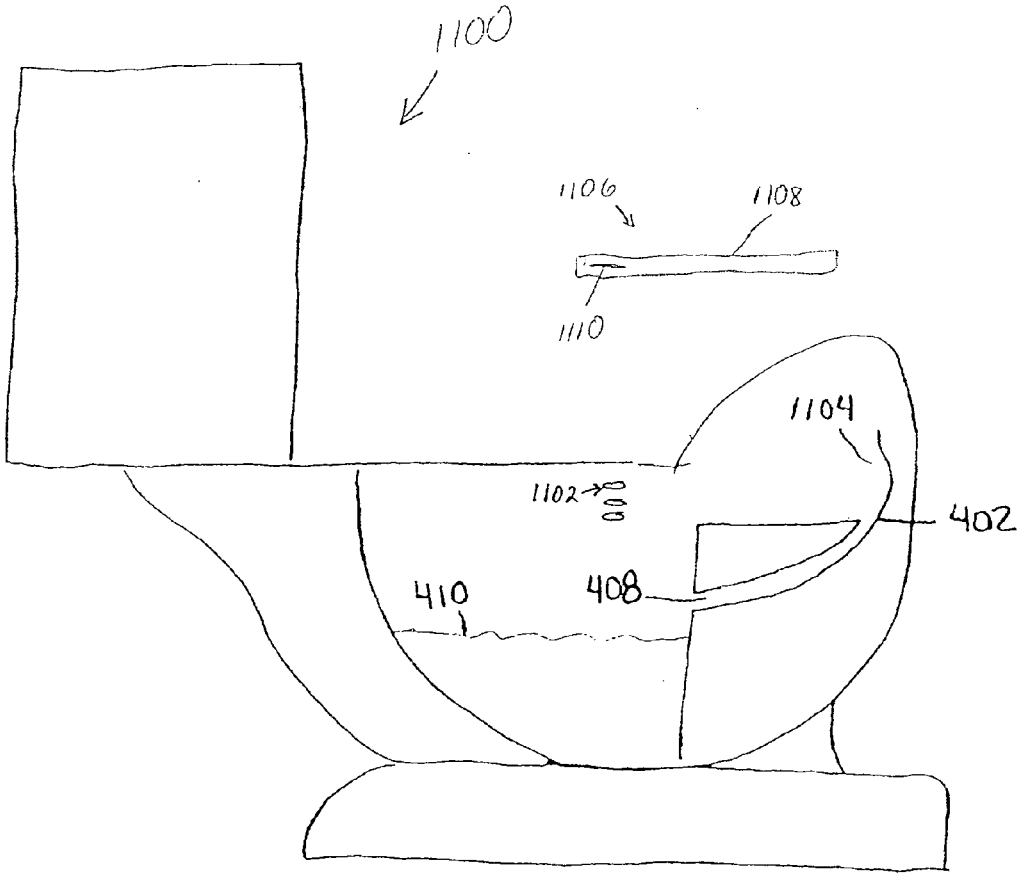
FIG. 11 is a side view of a shelf insert and a toilet with an extended portion at the top of the bowl in accordance with another exemplary embodiment of the present invention.

FIG. 11 is an side view of a toilet 1100 in accordance with another embodiment of the present invention. Toilet 1100 differs from toilet 200 of FIG. 2 in three respects. First, toilet 1100 does not include a rest for the penis. Second, toilet 1100 includes height adjusting indentations 1102 disposed along the inside of the bowl. Third, opening 1104 is elongated for reasons as discussed below.

A shelf insert 1106, which may be disposable, is usable with toilet 1100. Shelf insert 1106 includes a body portion 1108 shaped to receive a penis and tabs 1110 to be inserted into height adjusting indentations 1102. Body portion 1108 is shaped so as to drain urine from the penis and into opening 1104. Accordingly, opening 1104 should have an elongated shape in order to accommodate the different placement positions of body portion 1108. Shelf insert 1106 is sufficiently flexible to permit insertion and removal of tabs 1110 into height adjusting indentations 1102. Accordingly, shelf insert 1106 may be placed at a plurality of heights that are between the top of the bowl of the conventional toilet and the waterline in order to provide a more customized position to rest the penis and to prevent the urine from discharging between the seat and the top of the bowl.

Figure 12:
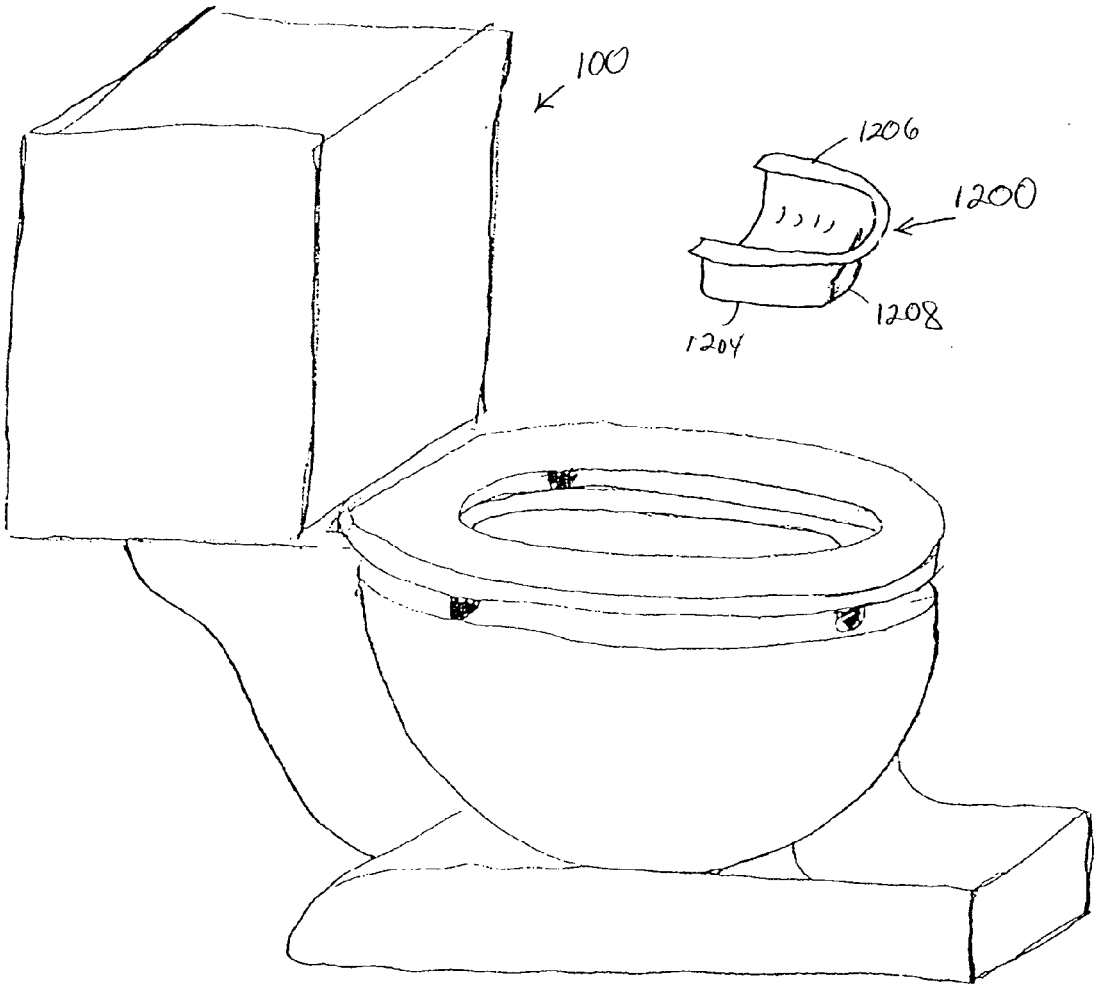
FIG. 12 illustrates a shelf in accordance with another exemplary embodiment of the present invention that is usable with a conventional toilet.

In a further embodiment of the present invention, for example as illustrated FIG. 12, a shelf 1200 may be used with conventional toilet 100. Shelf 1200 includes a body portion 1204 to receive a penis and a lip portion 1206 to rest on the seat of conventional toilet 1202. Body portion 1204 is shaped so as to drain urine from the penis toward opening 1208 and into the bowl of conventional toilet 1202. Lip portion 1206 is shaped to stably retain shelf 1200 on conventional toilet 1202 and to position body portion 1204 at a height that is between the top of the bowl of the conventional toilet and waterline in order to provide a more comfortable position to rest the penis and to prevent the urine from discharging between the seat and the top of the bowl.

With respect to the above, the parts of the invention may vary in size, shape, form, function and the manner of operation, assembly and use, as deemed apparent to one skilled in the art. All specifications mentioned are intended to be included in the present convention. As changes may occur as reviewed by those skilled in the art, it is not desired to limit the invention to the exact construction and operation shown and described above. Modifications may be made as long as it holds fast the principles of the invention.

What is claimed is:

1. A toilet for use by a male to sit while urinating, said toilet comprising:

a tank;

a bowl having a back portion, a front portion and a top, said back portion being disposed between said front portion and said tank; and a base disposed so as to support said bowl, wherein said bowl comprises an extended portion, a penis shelf and a disposal path, wherein said extended portion is located at said front portion of said bowl and is shaped to have a height, width and curvature that prevent urine from escaping over said top of said bowl, wherein said penis shelf is arranged and designed to permit a penis to rest thereon such that during urination, urine is discharged toward said disposal path.

2. The toilet of claim 1, wherein said disposal path includes an inlet disposed to receive discharged urine from said penis shelf, an outlet to discharge the urine into said bowl and piping connecting said inlet to said outlet.

3. The toilet of claim 2, wherein said outlet is disposed above a waterline of water in said bowl.

4. The toilet of claim 1, wherein said penis shelf is generally planar.

5. The toilet of claim 1, wherein said penis shelf includes a depressed central portion operable to center the penis with said disposal path.

* * * * *